United States Patent [19]

Perry

[11] Patent Number: 4,467,542

[45] Date of Patent: Aug. 28, 1984

[54] CHART SEQUENCING DEVICE

[76] Inventor: Robert E. Perry, 852 W. Las Palmas Dr., Fullerton, Calif. 92635

[21] Appl. No.: 94,640

[22] Filed: Nov. 15, 1979

[51] Int. Cl.[3] ..... G09F 19/00

[52] U.S. Cl. ..... 40/530; 40/513

[58] Field of Search ..... 221/312, 289; 40/508, 40/509, 511, 531, 513, 491, 381, 380, 476

[56] References Cited

U.S. PATENT DOCUMENTS

| | | | |
|---|---|---|---|
| 378,345 | 2/1888 | Valentine | 40/476 |
| 535,635 | 3/1895 | Stone | 40/508 |
| 614,372 | 11/1898 | Ramus | 40/531 |
| 1,081,766 | 12/1913 | Moore | 40/513 |
| 1,446,731 | 2/1923 | Williamson | 40/511 |
| 3,513,576 | 5/1970 | Mugaas | 40/509 |
| 3,912,124 | 10/1975 | Pinkerton | 221/289 |

*Primary Examiner*—Gene Mancene
*Assistant Examiner*—Wenceslao J. Contrera
*Attorney, Agent, or Firm*—Spensley Horn Jubas & Lubitz

[57] ABSTRACT

A device for sequentially exhibiting the individual charts in a stack of charts, each of the charts having a plurality of spaced notches along the lower edge thereof, the notches on consecutive charts being misaligned, comprising a display area having a lower shelf on which the stack of charts rest, the shelf being sloped forwardly and downwardly to direct the charts to and off the front edge thereof, a sliding comb assembly positioned adjacent the shelf, the comb assembly including a plurality of spaced teeth, the spacing between the teeth being the same as the spacing between the chart notches, the teeth extending upwardly and inwardly adjacent and along the front edge of the shelf to block movement of the charts off of the shelf except when the notches on a chart are aligned with the teeth, the comb assembly being slideable laterally relative to the shelf to align the teeth thereof with consecutive charts to deliver consecutive charts from the display area, and a spent chart magazine positioned to catch the charts delivered from the display area.

12 Claims, 5 Drawing Figures

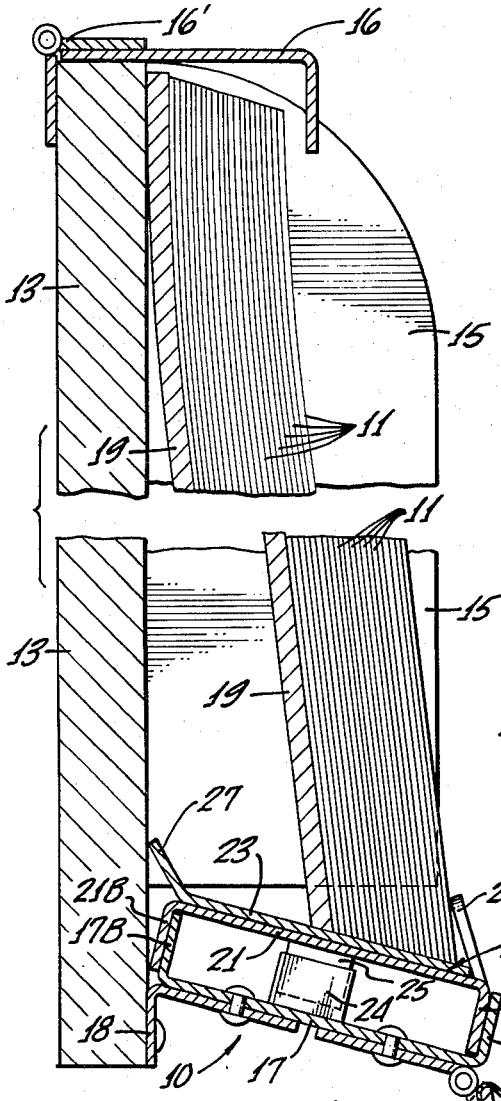
FIG. 4.
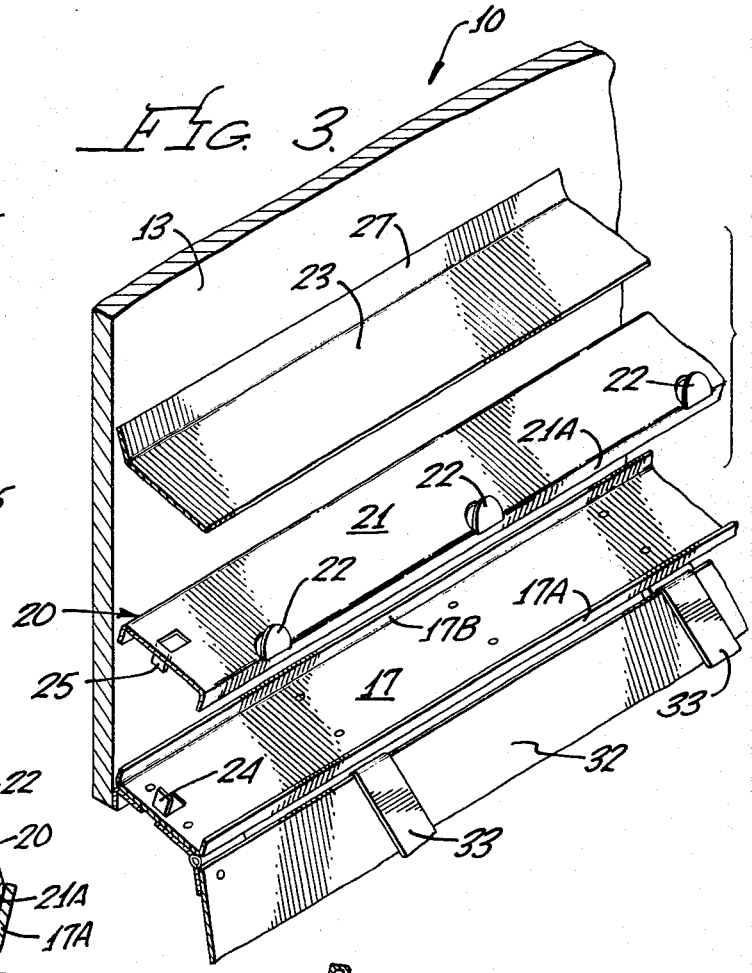
FIG. 3.
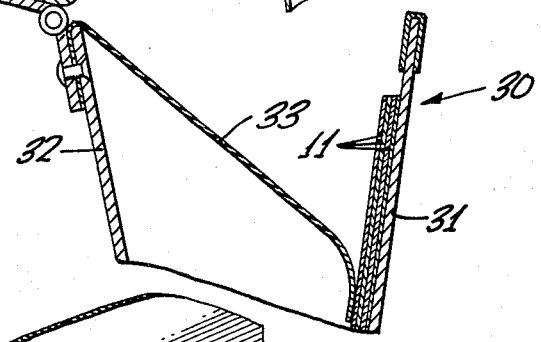
FIG. 5.
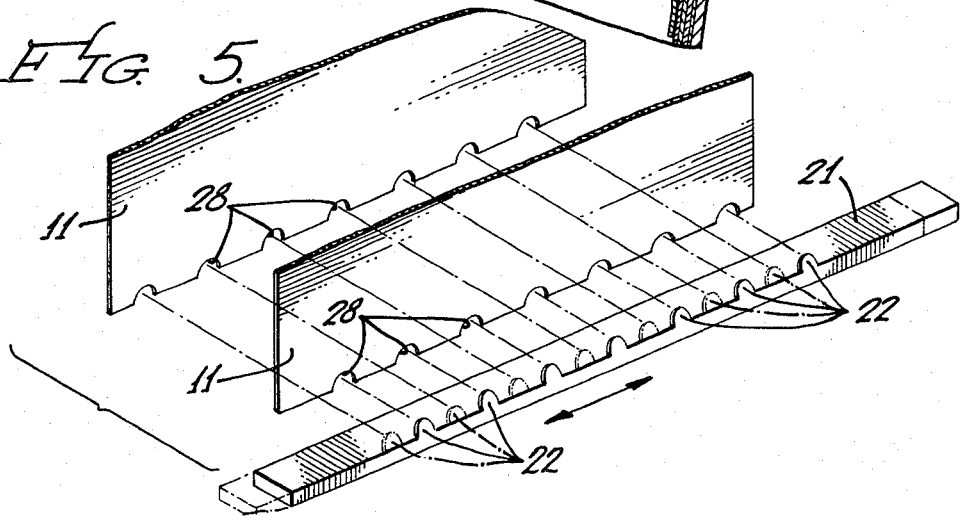

CHART SEQUENCING DEVICE

BACKGROUND OF THE INVENTION

1. Field of the Invention

The present invention relates to a chart sequencing device and, more particularly, to a device for sequentially exhibiting the individual charts in a stack of charts.

2. Description of the Prior Art

In the fields of advertising, lecturing, presentations, and the like, it is known to sequentially exhibit a series of messages in printed form. For example, in the giving of a lecture, it is known to display a sequence of charts on consecutive sheets of paper, which sheets are typically supported along the top edges thereof, with individual charts being flipped over as they are no longer needed. It is also known to use slide projectors to display information. In advertising, it is known to provide advertising information on card stock and to periodically change the message. Similar circumstances exist when presenting various types of information for display purposes, such as when displaying art objects, photographs, and the like.

In those circumstances where it is desired to sequentially display information of this type, it has been found desirable to provide means for automatically sequencing cards, charts, photographs, and the like. For example, U.S. Pat. No. 452,859 discloses a photographic stand in which the photographs are made to change their places, one after the other, by means of a slide mechanism. U.S. Pat. Nos. 2,577,596, 3,110,976, 3,513,576 and 3,570,155 all disclose advertising machines in which a series of cards or the like are successively exhibited for a brief period.

While the convenience of providing a machine in which a series of cards or the like may be successively exhibited has been known, the devices developed to achieve such purpose have been generally unsatisfactory for a variety of reasons. In most cases, the devices have been overly complex and inconvenient to use. Furthermore, prior devices are generally inoperative if anything else than card stock is employed. This latter disadvantage has made conventional devices inoperative if paper charts are used, as in flip charts, which is generally the medium of choice in lecture situations. Prior devices have also been expensive and clumsy to transport and use. Slide projectors are undesirable because they require a lecture to be given in a darkened room.

SUMMARY OF THE INVENTION

According to the present invention, these problems are solved by the provision of a novel chart sequencing device. The present chart sequencing device is simple in construction, having no complex, cumbersome, or expensive mechanical parts. Furthermore, the present device is ideally suited for use with paper, as well as card stock and the like, so that it is readily useable in place of flip charts for training and presentation purposes. The present device can be readily transported and used in a simple and convenient manner and could be easily scaled down for desk top use by sales persons and others.

Briefly, the device of the present invention is designed for sequentially exhibiting the individual charts in a stack of charts, each of the charts having a plurality of spaced notches along the lower edge thereof, the notches on consecutive charts being misaligned, the device comprising a display area having a back surface for supporting the charts and a lower shelf on which the charts rest, the shelf being sloped forwardly and downwardly to direct the charts to and off the front edge thereof, a sliding comb assembly positioned adjacent the shelf and including a plurality of spaced teeth, the spacing between the teeth being the same as the spacing between the chart notches, the teeth extending upwardly and inwardly adjacent and along the front edge of the shelf to block movement of the charts off of the shelf except when the notches on a chart are aligned with the teeth, the comb assembly being slideable laterally relative to the shelf to align the teeth thereof with consecutive charts to deliver consecutive charts from the display area, and a spent chart magazine positioned to receive the charts delivered from the display area.

OBJECTS, FEATURES, AND ADVANTAGES

It is therefore an object of the present invention to solve the problems associated with chart exhibiting devices. It is a feature of the present invention to solve these problems by providing a chart sequencing device useable with paper charts. It is a further feature of the present invention to solve these problems by providing a device which is mechanically simple in construction. It is a still further feature of the present invention to solve these problems by providing a device which is convenient to use. An advantage to be derived is that the present chart sequencing device is ideally suited for training and presentations where flip charts or slide projectors are normally used. A further advantage is that manual flip charts and troublesome slide projectors may be eliminated. A still further advantage is that a presentation by a sales person or lecturer is substantially enhanced.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 3 is a view similar to FIG. 2 with the parts of the device shown exploded;

FIG. 4 is a sectional view of the same area of the device of FIG. 1 shown in FIG. 2; and FIG. 5 is a diagrammatic view showing the arrangement of the notches in the charts for use with the device of FIG. 1.

DESCRIPTION OF THE PREFERRED EMBODIMENT

Figure 1:
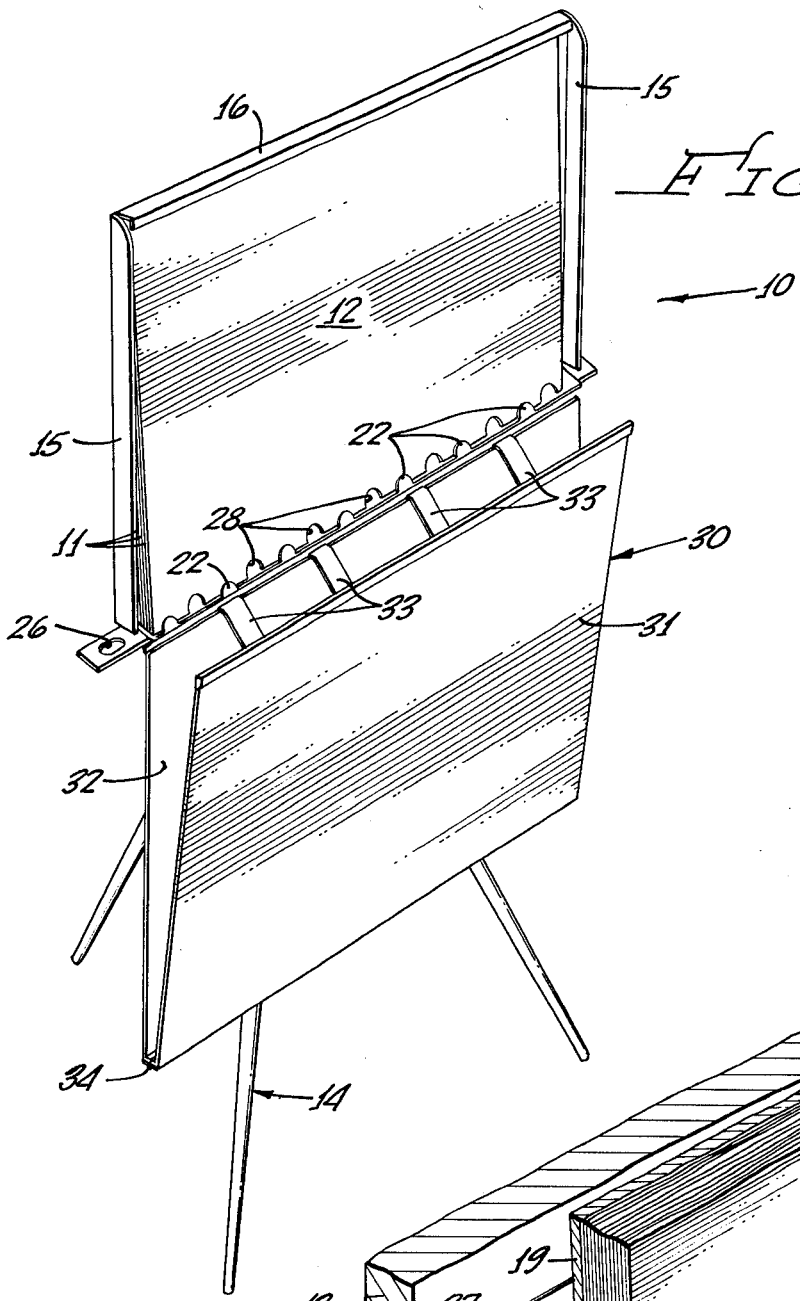
FIG. 1 is a perspective view of a chart sequencing device constructed in accordance with the teachings of the present invention.

Referring now to the drawings, the present chart sequencing device, generally designated 10, will be described in its preferred embodiment as a device useable in a lecture situation as a substitute for a conventional flip chart device. Specifically, device 10 will be described in an embodiment where it is suitable for sequentially displaying a plurality of charts 11 arranged in a stack where charts 11 are made from paper. However, it will be recognized by those skilled in the art that device 10 may be used with any other type of sheet stock such as photographs, card stock, paintings, and the like, and the word chart used herein is intended to include all of these types of sheet stock.

Device 10 has a display area 12 where charts 11 are supported to be viewed by an audience. Where paper charts are used, a rigid panel 19 is used as a backing to assure that the charts will not bow in the middle. While display area 12 can be formed in any convenient manner, it preferably includes a rectangular display panel 13 which may conveniently be made from wood or metal. The remaining parts of device 10 are preferably made from metal, but could be readily made from other materials. Panel 13 is supported at some convenient height by a conventional tripod 14, only the legs of which are shown in FIG. 1. Panel 13 may be secured to tripod 14 in any convenient manner. Secured to the opposite sides of display panel 13 are a pair of chart guide flanges 15. Flanges 15 may be adjustable to accomodate various chart sizes but, in any event, constrain the sides of the consecutive charts 11. Conveniently included where charts 11 are made from paper is a chart retainer strip 16 secured along the top edge of display panel 13 by means of a hinge 16'. The purpose of strip 16 is to keep the top edges of charts 11 from curling forward. Hinge 16' permits elevation of strip 16 for insertion of charts 11 into display area 12.

Secured along the bottom front edge of display panel 13 is an upwardly facing, elongate, U-shaped channel 17 which functions as a support and a guide, as will be explained more fully hereinafter. According to the preferred embodiment, channel 17 is made from metal and is secured to the bottom edge of display panel 13 by means of a plurality of angular brackets 18. Brackets 18 may be connected to panel 13 by screws and to channel 17 by rivets. For reasons which will appear more fully hereinafter, brackets 18 support channel 17 at an angle of approximately 20° relative to the horizontal.

Mating with channel 17 is a sliding comb assembly 20. Comb assembly 20 includes a downwardly facing, elongate, U-shaped channel 21 which is virtually identical to channel 17. The forward lip 21A of channel 21 extends in back of the forward lip 17A of channel 17 whereas the rear lip 21B of channel 21 preferably extends behind the rear lip 17B of channel 17. Comb assembly 20 also includes a plurality of teeth 22 which are struck up from the body of channel 21. Teeth 22 are spaced along channel 21 at relatively wide intervals and extend upwardly and inwardly from front lip 21A of channel 21 at an angle about 30° from the vertical. The reason for this will appear more fully hereinafter.

Resting on channel 21 of comb assembly 20 is an elongate chart shelf 23 which is a planar member having a lip 27 at the rear end thereof which extends at an angle of approximately 45° to shelf 23. Shelf 23 defines the lower end of display area 12 and is the element on which charts 11 rest. While shelf 23 is not connected to any other component, it is stationary in operation of device 10 and prevented from moving relative to display panel 13 because lip 27 is constrained between chart guide flanges 15.

Figure 2:
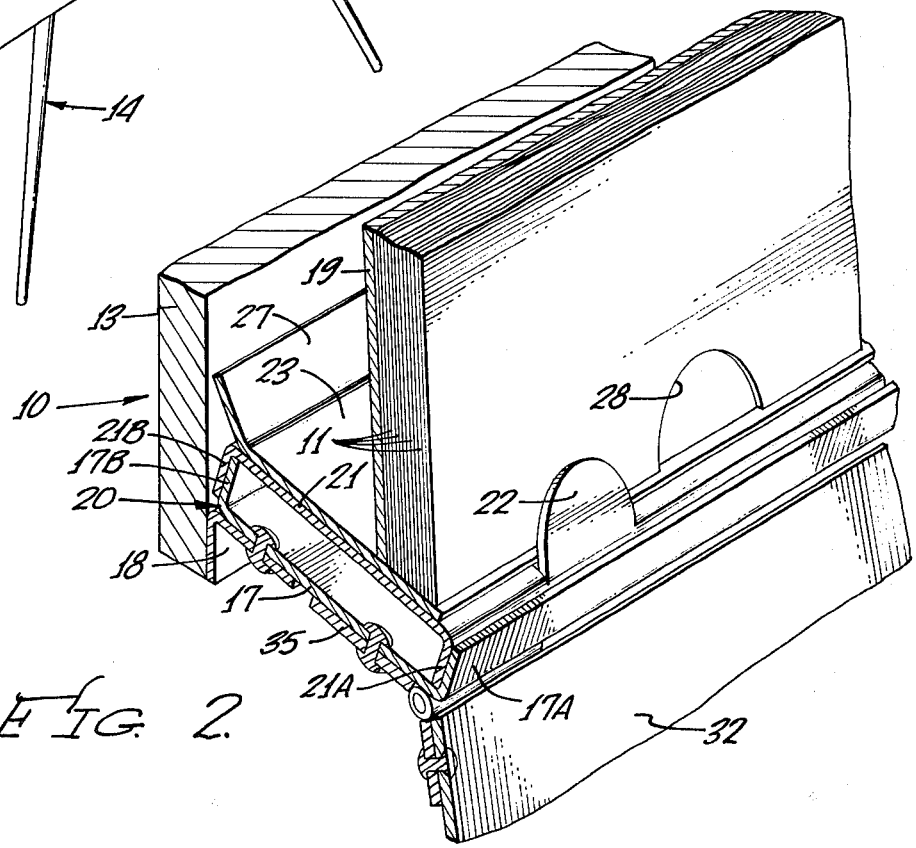
FIG. 2 is an enlarged, perspective, sectional view of a portion of the device of FIG. 1.

As can be seen from an inspection of FIGS. 2 and 4, the purpose of supporting channel 17 relative to display panel 13 at an angle is because channel 17 thereby supports comb assembly 20 and shelf 23 at the same angle. As a result, shelf 23 slopes forwardly and downwardly to direct the lower edges of charts 11 to, and ultimately off of, the front edge thereof. It is preferred that the angle of shelf 23 be at least 20° from the horizontal to ensure that a chart 11 resting thereon will be directed off the front edge thereof. However, any angle can be used which will insure a gravity feed of charts 11. Shelf 23 provides a stationary surface to reduce wear on the lower edges of charts 11 and to reduce friction on comb assembly 20 which is slideable laterally between channel 17 and shelf 23.

The movement of channel 21 is preferably limited so that comb assembly 20 translates between first and second fixed positions. This may be achieved most conveniently by positioning a first pair of stops 24 on channel 17, only one stop 24 being shown, and by positioning a second pair of stops 25 on channel 21, only one stop 25 being shown. Stops 24 and 25 are positioned so that when comb assembly 20 moves to the left, one of stops 25 thereon contacts one of stops 24 on channel 17 and when comb assembly 20 moves to the right, the other stop 25 thereon contacts the other stop 24 on channel 17. Alternatively, a single stop 25 on sliding comb assembly 20 can engage a pair of spaced stops on channel 17.

It can be seen from the above that comb assembly 20 is the only moving part of device 10, comb assembly 20 translating laterally between the positions discussed hereinabove. Comb assembly 20 can be positioned either manually or with suitable solenoids or motors by remote control. For use in a lecture situation, comb assembly 20 may have an extension 26 of channel 21 which extends outwardly from one side of display area 12 or the other, beneath guide flange 15, so that a lecturer can use such extension to slide comb assembly 20.

As shown most clearly in FIGS. 1, 2, and 5, each of said charts 11 has a plurality of spaced notches 28 along the lower edge thereof, the spacing between notches 28 being the same as the spacing between teeth 22 of comb assembly 20. Furthermore, each notch 28 is of the same shape, but slightly larger than, teeth 22. This permits teeth 22 to readily pass through the notches 28 on a given chart 11 when the notches 28 on a chart 11 are aligned with teeth 22. Furthermore, while the notches 28 on a first set of alternate charts 11 are aligned and the notches 28 on a second set of alternate charts 11 are aligned, the notches 28 of the first set of charts 11 are misaligned with the notches 28 of the second set of charts 11. The two sets of positions of the notches 28 on the two sets of alternate charts 11 correspond to the first and second positions of sliding comb assembly 20. Thus, as shown in FIG. 5, when comb assembly 20 is in its first position, shown in solid lines, it is aligned with the notches 28 on half of charts 11 whereas when comb assembly 20 is in its second position, shown in phantom, it is aligned with the notches 28 on the remaining half of charts 11.

The manner in which device 10 may be used to automatically deliver consecutive charts 11 from display area 12 may be seen most readily in FIGS. 1 and 2. That is, with comb assembly 20 in the position shown, it is obvious that the front-most chart 11 is prevented from moving off of shelf 23. However, if comb assembly 20 is slid to the right so that the teeth 22 thereon are aligned with the notches 28 in the front-most chart 11, teeth 22 will no longer prevent the front-most chart 11 from sliding off of shelf 23 and such chart will indeed slide off of the front edge of shelf 23. However, since the notches 28 on the next chart 11 are not aligned with the new position of teeth 22, the next chart 11 is trapped behind teeth 22 and cannot slide off of shelf 23. However, when it is desired to deliver such chart 11 from shelf 23, comb assembly 20 is moved back to the left and the procedure repeats. Accordingly, when any chart 11 slides forwardly over teeth 22, the next chart 11 is automatically retained. Teeth 22 are angled into the plane of charts 11 to provide a curved surface which rides over the edges of the paper at notches 28. This angle also carries charts 11 over teeth 22 as they drop down shelf 23.

A spent chart magazine 30 is suspended below display area 12 to receive the charts 11 delivered therefrom. Magazine 30 is a generally V-shaped member having front and rear panels 31 and 32, respectively, which are interconnected at the bottoms thereof by means of a spring-loaded hinge 34 which acts to close front panel 31 up against back panel 32. Magazine 30 is open at the top and sides thereof. Rear panel 32 is suspended below display area 12 such as by being connected to the bottom surface of channel 17 by a hinge 35. As is clearly seen in FIGS. 1 and 4, this suspends magazine 30 in position to receive the charts 11 delivered from display area 12. A plurality of spring guide strips 33 have first ends connected to back panel 32 and extend across the open upper end of magazine 30, with the free ends thereof contacting front panel 31 thereof. Guide strips 33 serve to keep panels 31 and 32 open sufficiently so that charts 11 may drop therebetween and to slow the descending charts 11 to save wear and diminish noise. Most importantly, however, guide strips 33 act to insure that the spent charts 11 are stacked in the same sequence as they were originally used. That is, the strips 33 hold the spent charts 11 against front panel 31 and insure that each new chart 11 entering magazine 30 enters in back of the last chart 11 having entered thereinto.

In operation, a lecturer, salesperson, or the like, desiring to use device 10 to sequentially display charts 11, positions the stack of charts 11 on shelf 23, between guide flanges 15 and beneath retainer strip 16. As the lecturer proceeds, each chart 11 is trapped on shelf 23 behind teeth 22 until the lecturer decides that the chart 11 being displayed is to be delivered into magazine 30 so that the next chart 11 may be viewed. This is achieved very simply by sliding the comb assembly 20 from the position it is in to its alternate position. This permits the existing front chart 11 to slide off the front edge of shelf 23 into magazine 30. The next chart 11 is automatically constrained behind teeth 22. By the simple expedient of alternating the positions of comb assembly 20, all of the charts 11 are delivered to magazine 30 where they are stacked in the same sequence as they were originally used.

It can therefore be seen that according to the present invention, there is provided a novel chart sequencing device which is simple in construction, having no complex, cumbersome, or expensive mechanical parts. Furthermore, the present device is ideally suited for use with paper, as well as card stock and the like, so that it is readily useable in place of flip charts for training and presentation purposes. The present device can be readily transported and used in a simple and convenient manner and could be readily scaled down for desk top use by salespersons and others.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A device for sequentially exhibiting the individual charts in a stack of charts, each of said charts having a plurality of spaced notches along the lower edge thereof, the notches on consecutive charts in said stack being misaligned, comprising:

a display area having a back surface for supporting said stack of charts, support means connected adjacent the lower edge of said back surface, and a stationary lower shelf on which said charts rest, said shelf being sloped forwardly and downwardly to direct said charts to and off the front edge thereof; and a sliding comb assembly resting on said support means and being supported thereby for slidable movement laterally relative thereto, said comb assembly including a plurality of spaced teeth, the spacing between said teeth being the same as the spacing between said chart notches, said teeth extending upwardly and inwardly adjacent and along said front edge of said shelf to block movement of said charts off of said shelf except when the notches on a chart are aligned with said teeth, said comb assembly being slidable laterally relative to said stationary shelf to align the teeth thereof with the notches in consecutive charts to deliver consecutive charts from said display area.

2. A chart sequencing device according to claim 1, wherein said shelf is positioned at an angle which will insure a gravity feed of said charts off of said shelf.

3. A chart sequencing device according to claim 1, wherein said shelf is positioned at an angle of at least 20° to the horizontal.

4. A chart sequencing device according to claim 1, wherein the notches on first alternate charts in said stack are aligned and the notches on second alternate charts in said stack are aligned, the notches on said first and second charts being misaligned, and wherein said comb assembly is slideable between first and second positions in which the teeth thereof are aligned with the notches on said first and second alternate charts, respectively.

5. A chart sequencing device according to claim 4, further comprising:

stop means on said comb assembly for limiting movement of said comb assembly between said first and second positions.

6. A chart sequencing device according to claim 1, wherein said display area comprises:

a rigid display panel defining said back surface; and guide means secured to said display panel, on opposite sides thereof, for retaining said charts therebetween.

7. A chart sequencing device according to claim 6, wherein said lower shelf rests on said sliding comb assembly and is prevented from moving laterally therewith by said guide means.

8. A chart sequencing device according to claim 1, further comprising:

a magazine being open at the upper end thereof for receipt of charts delivered from said display area, said magazine being connected to said support means.

9. A chart sequencing device according to claim 8, further comprising:

a plurality of spring guide strips extending across said open upper end of said magazine for stacking said charts in a desired sequence.

10. A chart sequencing device according to claim 1, wherein said lower shelf rests on said sliding comb assembly.

11. A chart sequencing device according to claim 10, further comprising:

a magazine being open at the upper end thereof for receipt of charts delivered from said display area, said magazine being connected to said support means.

12. A chart sequencing device according to claim 11, further comprising:

a plurality of spring guide strips extending across said open upper end of said magazine for stacking said charts in a desired sequence.

* * * * *